US010443921B2

(12) United States Patent
Okazaki et al.

(10) Patent No.: US 10,443,921 B2
(45) Date of Patent: Oct. 15, 2019

(54) REFRIGERATOR

(71) Applicant: PANASONIC CORPORATION, Osaka (JP)

(72) Inventors: Toru Okazaki, Osaka (JP); Terutsugu Segawa, Osaka (JP); Yasuhiro Asaida, Kyoto (JP)

(73) Assignee: PANASONIC CORPORATION, Osaka (JP)

( * ) Notice: Subject to any disclaimer, the term of this patent is extended or adjusted under 35 U.S.C. 154(b) by 0 days.

(21) Appl. No.: 16/126,183

(22) Filed: Sep. 10, 2018

(65) Prior Publication Data

US 2019/0078829 A1 Mar. 14, 2019

(30) Foreign Application Priority Data

Sep. 11, 2017 (JP) ..... 2017-174146

(51) Int. Cl.
*F25D 21/04* (2006.01)
*F25D 23/06* (2006.01)
*F25B 39/04* (2006.01)

(52) U.S. Cl.
CPC ..... *F25D 21/04* (2013.01); *F25D 23/061* (2013.01); *F25D 23/066* (2013.01); *F25D 23/069* (2013.01); *F25B 39/04* (2013.01); *F25C 2400/10* (2013.01); *F25D 2400/04* (2013.01); *F25D 2700/121* (2013.01)

(58) Field of Classification Search
CPC ..... F25D 21/04; F25D 23/069; F25D 23/065; F25D 23/066
See application file for complete search history.

(56) References Cited

U.S. PATENT DOCUMENTS 4,150,518 A * 4/1979 Truesdell ..... F25D 21/04 220/592.08
4,955,676 A * 9/1990 Weaver ..... F25D 23/069 312/236
6,224,179 B1 * 5/2001 Wenning ..... F24C 15/34 312/406
2003/0157284 A1 * 8/2003 Tanimoto ..... B65D 81/18 428/36.1
2004/0104654 A1 * 6/2004 Lee ..... F25D 21/04 312/401

(Continued)

FOREIGN PATENT DOCUMENTS

JP 2000-213853 A 8/2000
JP 2015-048953 A 3/2015

*Primary Examiner* — Daniel J Rohrhoff
(74) *Attorney, Agent, or Firm* — McDermott Will & Emery LLP

(57) ABSTRACT

It is an object to provide a refrigerator that suppresses heat intrusion from a heat radiation pipe for suppressing dew condensation with respect to a partition plate of a refrigerator. The refrigerator includes a partition plate that partitions a room into a plurality of rooms and a door that seals the plurality of rooms. The partition plate includes an upper plate that positions on upper side, a lower plate that positions on lower side, a design plate that positions between the upper plate and the lower plate, and a heat insulating material fixed between the design plate and the upper plate or the lower plate in a compressed state in which a compressed portion has a thickness smaller than a thickness of other portions.

15 Claims, 16 Drawing Sheets

(56) References Cited

U.S. PATENT DOCUMENTS

| | | | | |
|---|---|---|---|---|
| 2007/0228407 | A1* | 10/2007 | Takeda | H01L 33/305 257/101 |
| 2012/0102985 | A1* | 5/2012 | Tafoya | F25D 21/04 62/81 |
| 2012/0313497 | A1* | 12/2012 | Jang | F25D 23/069 312/405 |
| 2013/0142983 | A1* | 6/2013 | Han | B32B 5/26 428/69 |
| 2014/0015394 | A1* | 1/2014 | Cha | B23P 15/26 312/404 |
| 2016/0187050 | A1* | 6/2016 | Odawara | F16L 59/026 428/212 |
| 2016/0370084 | A1* | 12/2016 | Bessho | C09K 5/063 |
| 2017/0159996 | A1* | 6/2017 | Deka | F25D 23/062 |
| 2017/0167782 | A1* | 6/2017 | Diptesh | F25D 23/066 |
| 2018/0073799 | A1* | 3/2018 | Okazaki | F25D 21/04 |

* cited by examiner

FIG. 6A
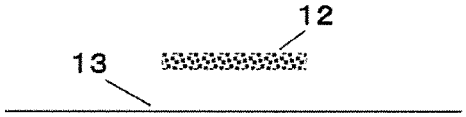
FIG. 6B
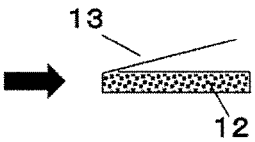
FIG. 6C
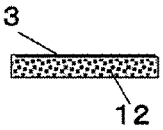
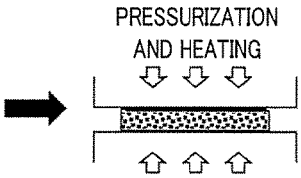
FIG. 6D
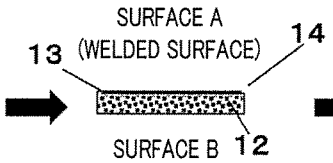
FIG. 6E
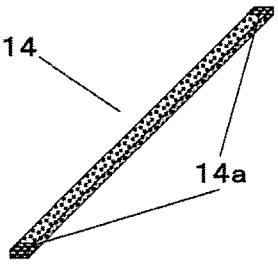
FIG. 6F
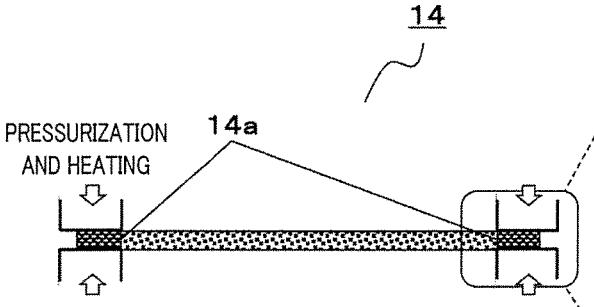
FIG. 7A
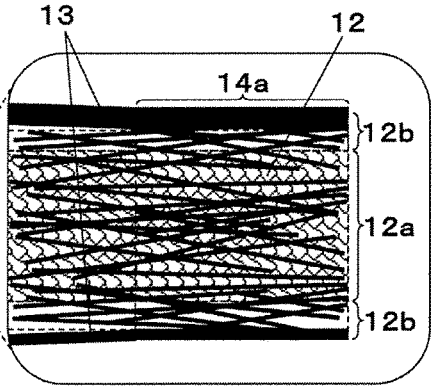
FIG. 7B

REFRIGERATOR

CROSS REFERENCE TO RELATED APPLICATIONS

This application is entitled to and claims the benefit of Japanese Patent Application No. 2017-174146, filed on Sep. 11, 2017, the disclosure of which including the specification, drawings and abstract is incorporated herein by reference in its entirety.

TECHNICAL FIELD

The present invention relates to a structure of a partition portion of a heat insulating box such as a refrigerator having a plurality of rooms. In particular, the present invention relates to a refrigerator including a partition plate that heats a design plate on which a door abuts to suppress dew condensation.

BACKGROUND ART

A heat insulating box such as a refrigerator having a plurality of rooms is provided with a partition plate that is a resin molded article including a heat insulating material inside thereof so that it is partitioned into rooms having different environments such as a temperature and a humidity depending on contents of stored food or the like.

The strength of the refrigerator is improved by the partition plate being mounted. In particular, a design plate located on an opening side of the box includes a design surface and an end side bent at a right angle to the design surface to form a substantially U-shaped cross section, and its end side is placed under an outer shell surface layer of the partition plate to be fixed in such a manner that the end side is covered. With this configuration, the strength of the heat insulating box is improved.

Further, since packing provided on a door and the box are held in a sealed state, the design plate is required to be adsorbed by a magnet provided inside the packing. At the same time, since the influence on strength improvement of the refrigerator is large, a low-priced coated steel plate of high strength is used for the design plate.

However, the design plate includes a portion exposed to the outside of the room and is made of a steel plate excellent in thermal conduction. Accordingly, a heat flow from a high temperature zone outside the room to a low temperature zone inside the room is generated on the end side of the design plate disposed near the outer shell surface of the partition plate. As a result, heat insulating performance of the heat insulating box decreases, and the temperature of the design plate itself drops to a dew point of the outside air (installation atmosphere of refrigerator) or lower, thereby causing dew condensation.

In response to such a problem, in PTL 1, an attempt to suppress occurrence of dew condensation is made. FIGS. 19 and 20 are views illustrating a structure of a conventional refrigerator and a structure of a peripheral region of a partition plate and a design plate with respect to the conventional refrigerator disclosed in PTL 1, respectively.

FIG. 19 is a view illustrating whole conventional refrigerator 200, and illustration of a door is omitted for simplicity. Refrigerator 200 includes inner box 4 made of plastic and outer box 5 made of metal in a combined state, and includes a plurality of storage rooms such as first storage room 2 and second storage room 3. Each storage room is partitioned by partition plate 1 made of plastic and design plate 11 made of metal mounted on a front face of the refrigerator.

FIG. 20 is a view illustrating a cross section of portion α in FIG. 19 in detail, which illustrates partition plate 1 between first storage room 2 and second storage room 3 and design plate 11. Partition plate 1 is configured by disposing upper plate 6 and lower plate 7 on upper and lower sides of foamed urethane heat insulating material 8 enclosed from the back surface of the refrigerator, respectively. Further, heat radiation pipe 10 for heat radiation of a refrigerating cycle is disposed on foamed urethane heat insulating material 8 and the front surface thereof between upper plate 6 and lower plate 7. Heat radiation pipe 10 is in contact with design plate 11 via heat storage layer 18. Solid foamed flexible heat insulating material 9 including an expanded polystyrene and the like, which is provided to suppress urethane leakage to the front surface of the refrigerator, is pressed by design plate 11 when foamed urethane heat insulating material 8 is enclosed from the back surface of the refrigerator. With such a temperature raising mechanism, heat generated in heat radiation pipe 10 is transmitted to design plate 11 and a peripheral region such as gasket 17 of door 16, and the temperature of design plate 11 and the peripheral region such as gasket 17 is raised to the dew point or higher, thereby suppressing occurrence of dew condensation.

The temperature raising mechanism is compatible with the heat radiation of the refrigerating cycle and dew condensation suppression at the peripheral region of the design plate, and is a highly efficient energy saving mechanism. However, in the mechanism described above, heat radiation pipe 10, heat storage layer 18, design plate 11, and upper plate 6 or lower plate 7 of partition plate 1 are placed in contact with one another, whereby the heat generated in heat radiation pipe 10 tends to intrude into the storage room through path A illustrated in FIG. 20. Energy saving performance of the refrigerator is greatly impaired when the heat of heat radiation pipe 10 having a temperature higher than the room temperature intrudes into the storage room.

In order to avoid such a problem, there is a structure disclosed in PTL 2. FIGS. 21 and 22 are views illustrating a structure of a conventional refrigerator and a structure of a peripheral region of a partition plate and a design plate with respect to the conventional refrigerator disclosed in PTL 2, respectively. FIG. 21 is a view illustrating whole conventional refrigerator 300, and illustration of a door is omitted for simplicity. Refrigerator 300 includes inner box 4 made of plastic and outer box 5 made of metal in a combined state, and includes a plurality of storage rooms such as first storage room 2 and second storage room 3. Each storage room is partitioned by partition plate 301 made of plastic and design plate 11 made of metal mounted on a front face of the refrigerator.

FIG. 22 is a view illustrating a cross section of portion α in FIG. 21 in detail, which illustrates partition plate 301 between first storage room 2 and second storage room 3 and design plate 11. In partition plate 301, upper plate 306 and lower plate 7 are disposed on upper and lower sides of foamed urethane heat insulating material 8 enclosed from the back surface of the refrigerator, respectively. Further, heat radiation pipe 10 for heat radiation of a refrigerating cycle is disposed on foamed urethane heat insulating material 8 and the front surface thereof between upper plate 306 and lower plate 7. Heat radiation pipe 10 is in contact with design plate 11 with the back surface thereof being pressed by solid foamed flexible heat insulating material 9 including an expanded polystyrene and the like.

In the present structure, upper plate 306 is devised to make it difficult for the heat of heat radiation pipe 10 to intrude into the storage room. That is, upper plate 306 is provided with heat barrier 302 having a thickness smaller than that of other resin portions is provided in a depth direction of the sheet of FIG. 22, and the heat of heat radiation pipe 10 intruding into the storage room through path A in the drawing is shielded by heat barrier 302 as much as possible. With such a mechanism, the heat insulating property of the refrigerator and the storage room is enhanced, and the energy saving performance is improved.

CITATION LIST

Patent Literature

PTL 1
Japanese Patent Application Laid-Open No. 2000-213853
PTL 2
Japanese Patent Application Laid-Open No. 2015-48953

SUMMARY OF INVENTION

Technical Problem

However, with the structure of the conventional refrigerator disclosed in PTL 1, the heat from the heat radiation pipe intruding into the storage room cannot be suppressed, and the energy saving performance of the refrigerator may be adversely affected.

Moreover, with the structure of the conventional refrigerator disclosed in PTL 2, although the problem of the energy saving performance mentioned in PTL 1 is addressed, a thin portion is formed on the resin (upper plate and lower plate) included in the partition plate, whereby it is difficult to maintain the flatness of the resin in the longitudinal direction of the design plate. That is, while FIG. 23A is a front view of the refrigerator in a case where the flatness of the resin included in the partition plate is not maintained and FIG. 23B is an enlarged view of the design plate and the peripheral region of the resin, in such a case, as illustrated in FIG. 23B, an opening state in which a gap (opening portion 307) is unevenly formed between design plate 11 and the resin (upper plate 306) occurs. The opening state not only impairs the aesthetic appearance of the front face of the refrigerator, but also causes a serious defect in which, for example, at a portion where the gap between the design plate and the upper plate or the lower plate is large, moisture enters inside to become rotten. Therefore, an object of the present invention is to maintain performance and aesthetic appearance of a refrigerator while maintaining heat insulating property of a peripheral region of a design plate and strength of a partition plate without causing an opening state with the design plate.

Solution to Problem

A refrigerator of the present invention includes: a partition plate that partitions a room into a plurality of rooms; and a door that seals the plurality of rooms, in which the partition plate includes: an upper plate that positions on upper side; a lower plate that positions on lower side; a design plate that positions between the upper plate and the lower plate; and a heat insulating material fixed between the design plate and the upper plate or the lower plate in a compressed state and a compressed portion has a thickness smaller than a thickness of other portions.

Advantageous Effects of Invention

According to the present invention, the performance of the refrigerator can be secured and the aesthetic appearance can be maintained while dew condensation suppression in the vicinity of the partition plate is achieved and the heat intruding into the refrigerator via the design plate is suppressed.

BRIEF DESCRIPTION OF DRAWINGS

FIGS. 6A to 6F are views illustrating a method of laminating a film with respect to the soft composite heat insulating material;

FIG. 6A is a view illustrating the soft composite heat insulating material and a laminate film included in a laminated heat insulator;

FIG. 6B is a view illustrating a step of wrapping the laminate film around the soft composite heat insulating material;

FIG. 6C is a view illustrating a thickness configuration of the laminate film after the wrapping step;

FIG. 6D is a view illustrating a step for welding the soft composite heat insulating material and the laminate film to form a composite;

FIG. 6E is a view illustrating a cross-sectional structure of a completed laminated heat insulator;

FIG. 6F is a view illustrating an overall configuration of the completed laminated heat insulator;

FIGS. 7A and 7B are views illustrating a method of processing an end portion of a film laminating part of the soft composite heat insulating material;

FIG. 7A is a view illustrating a welding step of an end portion of the laminated heat insulator;

FIG. 7B is a view illustrating a structure of a welded portion within the end portion of the laminated heat insulator;

FIG. 14A is a view illustrating the method of mounting the design plate on the partition plate according to Embodiment 2;

FIG. 14B is a view illustrating a structure after the design plate is mounted on the partition plate according to Embodiment 2;

FIG. 14C is a view illustrating a heat insulating effect between a heat radiation pipe and the design plate according to Embodiment 2;

FIG. 16A is a view illustrating the method of mounting the design plate on the partition plate according to Embodiment 3;

FIG. 16B is a view illustrating a structure after the design plate is mounted on the partition plate according to Embodiment 3;

DESCRIPTION OF EMBODIMENTS

Hereinafter, embodiments of the present invention will be described with reference to the accompanying drawings.

Embodiment 1

Figure 1:
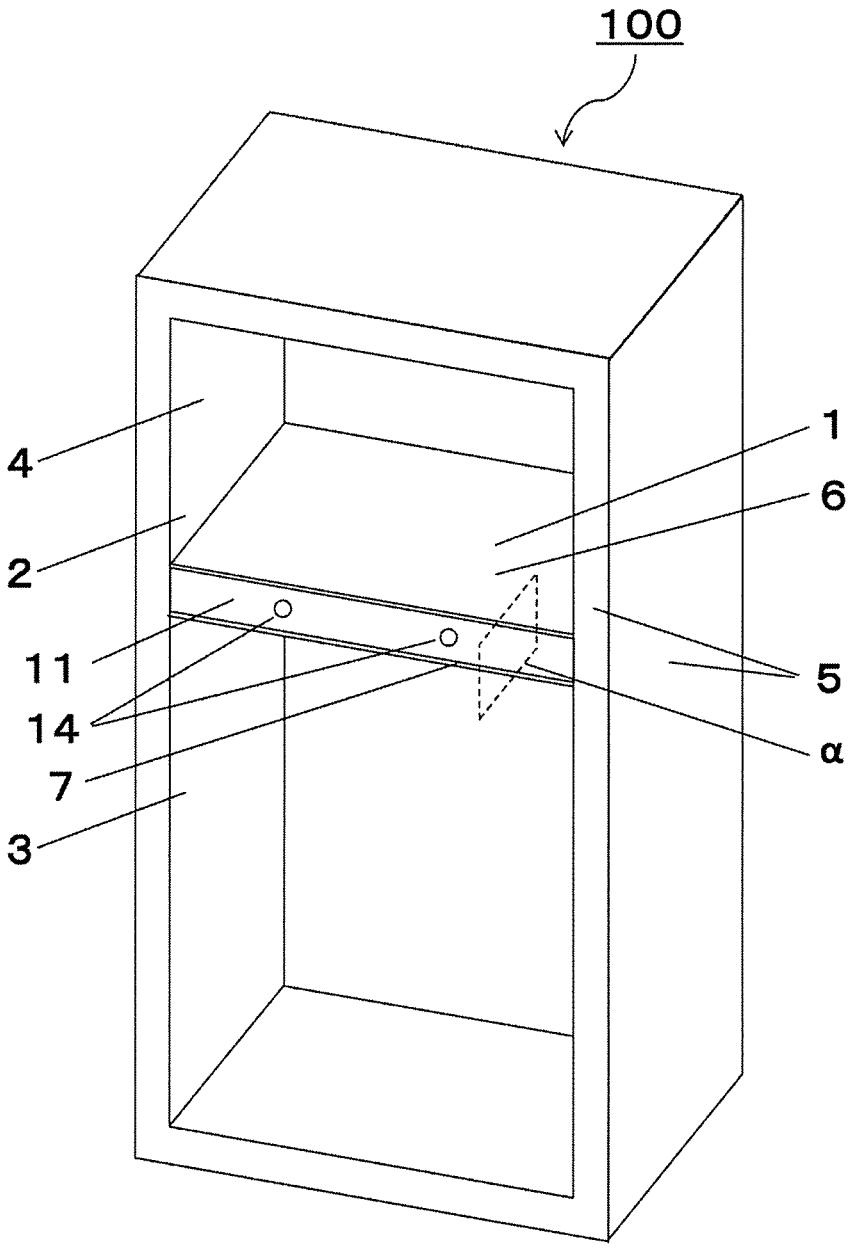
FIG. 1 is a view illustrating a structure of a refrigerator according to Embodiments 1 and 2.
Figure 2:
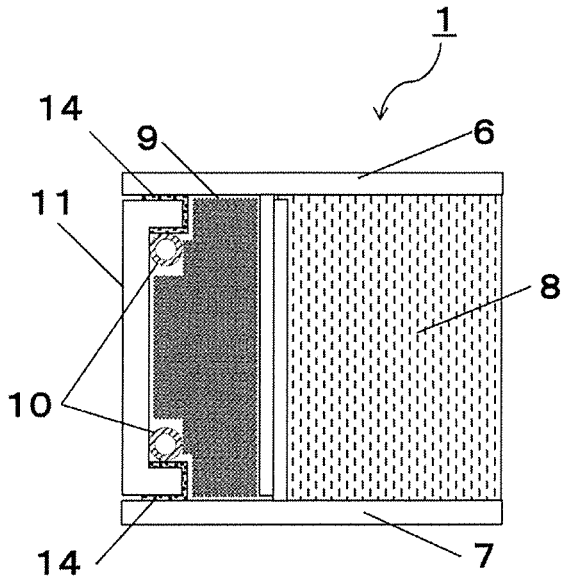
FIG. 2 is a longitudinal cross-sectional view of portion α in FIG. 1 according Embodiment 1.

FIG. 1 is a view illustrating a heat insulating box of a refrigerator according to Embodiment 1 of the present invention, and FIG. 2 is a longitudinal cross-sectional view of portion α in FIG. 1.

<Configuration of Refrigerator 100>

In FIG. 1, a refrigerator 100 includes outer box 5 made of metal such as a steel plate, inner box 4 made of resin such as an acrylonitrile-butadiene-styrene (ABS), and partition plate 1. Partition plate 1 is a partition that vertically partitions first storage room 2 and second storage room 3, and is disposed between rooms having different temperature zones such as a chiller serving as first storage room 2 and a freezer serving as second storage room 3.

<Configuration of Partition Plate 1>

In FIG. 2, partition plate 1 includes upper plate 6 and lower plate 7 on upper and lower sides, and heat radiation pipe 10 of a refrigerating cycle is provided on a front surface portion (front surface of the refrigerator) of upper plate 6 and lower plate 7 in such a manner that heat radiation pipe 10 is in contact with substantially U-shaped design plate 11. Further, laminated heat insulator 14 is attached to a side surface portion of the substantially U-shape of design plate 11 to cover the side surface portion of design plate 11, and a part of laminated heat insulator 14 is sandwiched between design plate 11 and upper plate 6 or between design plate 11 and lower plate 7 to be fixed in a compressed state.

In order to suppress thermal conduction from design plate 11 to upper plate 6 and lower plate 7, connection between design plate 11 and upper plate 6 and connection between design plate 11 and lower plate 7 are performed only via laminated heat insulator 14. In this manner, heat transmitted from heat radiation pipe 10 to the inside of the storage room (upper plate 6 and lower plate 7) via design plate 11 is suppressed without processing a resin material such as thinning a part of upper plate 6 or lower plate 7. Accordingly, while heat insulating property of the refrigerator is enhanced, aesthetic appearance can also be maintained without causing an opening state of partition plate 1 due to a deformation of upper plate 6 and lower plate 7.

Moreover, the rear side of the refrigerator between upper plate 6 and lower plate 7 is filled with foamed urethane heat insulating material 8, and foamed flexible heat insulating material 9 such as an expanded polystyrene is provided on the front side of the refrigerator behind design plate 11 and heat radiation pipe 10. Here, laminated heat insulator 14 may be provided at least on one side of both ends of design plate 11.

<Configuration of Laminated Heat Insulator 14>

Figure 3A:
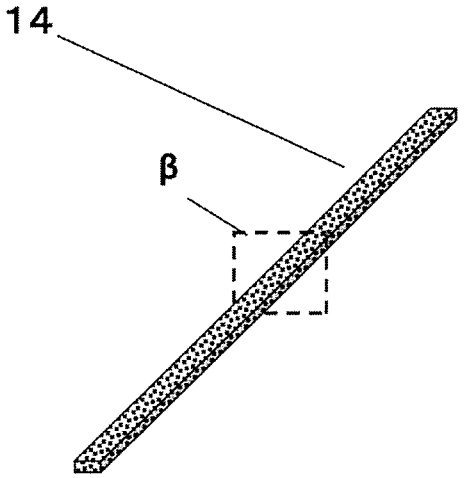
FIG. 3A is a view illustrating an overall structure of a laminated heat insulator.
Figure 3B:
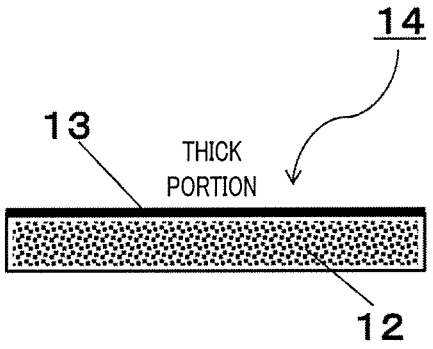
FIG. 3B is a cross-sectional view of portion β in FIG. 3A.

FIG. 3A is a view illustrating an overall structure of laminated heat insulator 14, and FIG. 3B is a cross-sectional view of portion β in FIG. 3A. As illustrated in FIG. 3A, laminated heat insulator 14 has an elongated structure. As illustrated in FIG. 3B, laminate film 13 such as a resin film wraps and seals soft composite heat insulating material 12 to form laminated heat insulator 14, and one surface of the front and rear sealing surfaces of soft composite heat insulating material 12 is thicker than other surfaces.

<Configuration of Soft Composite Heat Insulating Material 12>

Figure 4:
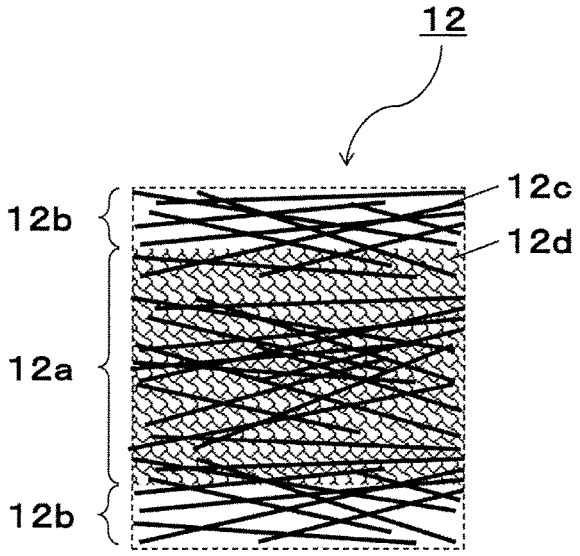
FIG. 4 is a view illustrating a cross-sectional structure of a soft composite heat insulating material.

Soft composite heat insulating material 12 illustrated in FIG. 4 is a composite of an aerogel and a fiber structure. Nonwoven fabric fiber 12*c* and aerogel 12*d* are constituent elements, and it has a layered structure including aerogel fiber composite layer 12*a* at its center and single fiber layer 12*b* above and below aerogel fiber composite layer 12*b*.

Aerogel fiber composite layer 12*a* is a composite of a fiber structure (e.g., nonwoven fabric) and an aerogel, and is obtained by immersing the fiber structure in an aerogel precursor and performing supercritical drying or drying at an ordinary pressure in the presence of the fiber structure so that the aerogel is generated from the aerogel precursor.

The aerogel is a solid with an extremely high porosity (preferably a porosity of 99% or more) having a large number of micropores. More specifically, it is a substance having a structure in which silicon dioxide or the like is bound like a string of beads and having a large number of voids at a nanometer level (e.g., 2 to 50 nm). As described above, since it has pores at the nanometer level and a grid-like structure, the mean free path of gas molecules can be reduced, thermal conduction between gas molecules is very small even under an ordinary pressure, and thermal conductivity is very low.

As the aerogel, it is preferable to use an inorganic aerogel including a metallic oxide such as silicon, aluminum, iron, copper, zirconium, hafnium, magnesium, and yttrium, and more preferably, silica aerogel including silicon dioxide.

The fiber structure serves as a reinforcing material or a support for reinforcing or supporting the aerogel, and a soft woven fabric, a knitted fabric, a nonwoven fabric, and the like is used to obtain a soft composite heat insulating material. As a material of the fiber structure, an inorganic fiber such as a glass fiber may also be used in addition to an organic fiber such as a polyester fiber.

The heat insulating material obtained in this manner has a thermal conductivity substantially equal to or less than that of the foamed urethane heat insulating material (approximately $\lambda$=0.020 W/m K), and is a material having a very high heat insulating property. Hereinafter, a method of manufacturing the refrigerator configured as described above and an effect thereof will be described.

<Manufacture of Soft Composite Heat Insulating Material 12>

A method of manufacturing soft composite heat insulating material 12 includes eight steps of (1) sol preparing step, (2) impregnating step, (3) stacking step, (4) gelling step, (5) curing step, (6) acidic aqueous solution immersing step, (7) hydrophobizing step, and (8) drying step. Hereinafter, these steps will be described for each step.

(1) Sol Preparing Step

In a sol preparing step, there are a case where a water glass is used as a raw material and a case where a high molar ratio silicate aqueous solution is used as a raw material. In the case of using the water glass, sodium in the water glass is removed using ion exchange resin or an electrodialysis method, make it acidic, make a sol, base is added as a catalyst, and polycondensation is carried out to obtain hydrogel. In the case of using a high molar ratio sodium silicate, acid is added to the high molar ratio silicate aqueous solution as a catalyst, and polycondensation is carried out to obtain hydrogel.

(2) Impregnating Step

A sol solution prepared in sol preparing step (1) is poured 6.5 to 10 times the weight of the nonwoven fabric into a nonwoven fabric including a PET having a thickness of 0.2 to 1.0 mm, a glass wool, a rock wool, and the like, and the nonwoven fabric is impregnated with the sol solution. A method of impregnation is to spread the sol solution on a film or the like in advance to a predetermined thickness, which is then covered by the nonwoven fabric, whereby the nonwoven fabric is impregnated with the sol solution.

(3) Stacking Step

Figure 5A:
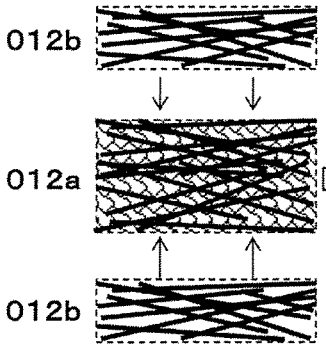
FIG. 5A is a view illustrating a structure of a soft composite heat insulator before stacking.
Figure 5B:
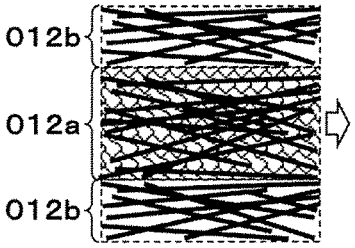
FIG. 5B is a view illustrating a structure of the soft composite heat insulator after the stacking.
Figure 5C:
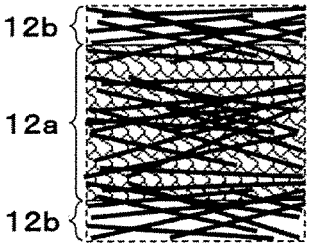
FIG. 5C is a view illustrating the soft composite heat insulating material after gel curing.

A stacking configuration will be described with reference to FIGS. 5A to 5C. Nonwoven fabric sol composite 012*a* illustrated in FIG. 5A has been completed up until impregnating step (2). In the stacking step, nonwoven fabric 012*b* illustrated in FIG. 5A is composited to nonwoven fabric sol composite 012*a* to produce elasticity of soft composite heat insulating material 12 in laminated heat insulator 14 illustrated in FIG. 3 at the time of compression and to serve as an elastic layer for reducing unevenness of the gap with design plate 11 due to warp and undulation of upper plate 6 and lower plate 7. First, as also illustrated in FIG. 5A, nonwoven fabric sol composite 012*a* having been subject to impregnating step (2) is sandwiched between nonwoven fabrics 012*b* placed up and down sides thereof, as illustrated in FIG. 5B. At this time, a part of the sol component in nonwoven fabric sol composite 012*a* permeates (impregnates) the region around the end surface of nonwoven fabric 012*b* due to osmotic pressure.

(4) Gelling Step

After stacking step (3), the sol is gelled. A gelation temperature of the sol is preferably 20 to 90° C. When the gelation temperature is lower than 20° C., the heat necessary for a silicate monomer that is active species of reaction is not transmitted. Accordingly, growth of silica particles is not promoted. As a result, it takes time until the sol gelation proceeds sufficiently. In addition, the strength of the gel (aerogel) to be produced is low, and the gel greatly contracts at times while being dried, whereby the aerogel having a desired strength cannot be obtained at times.

Moreover, when the gelation temperature exceeds 90° C., the growth of silica particles is remarkably accelerated. As a result, volatilization of water occurs rapidly, and there appears a phenomenon that water and hydrogel are separated. The volume of the hydrogel obtained thereby decreases, and silica aerogel cannot be obtained at times.

Here, although the gelation time varies depending on the gelation temperature and the curing time after gelling to be described later, it is preferably 0.1 to 12 hours in the sum of the gelation time and the curing time to be described later, and more preferably 0.1 to 1 hour from the viewpoint of achieving compatibility of the performance (thermal conductivity) with production tact.

When the gelation time is longer than 12 hours, although reinforcement of a silica network is sufficiently carried out, when more time is taken for the curing, not only productivity is impaired but also contraction of the gel occurs so that bulk density increases, thereby raising a problem that the thermal conductivity increases.

In this manner, the gelation improves the strength and rigidity of the wall of the hydrogel, and the hydrogel hard to contract when being dried can be obtained. Besides, the sol is solidified into the gel state so that the aerogel permeating the nonwoven fabric layer is solidified, whereby all layers are united to form a layered structure of aerogel fiber composite layer 12*a* and single fiber layer 12*b* as illustrated in FIG. 5C.

(5) Curing Step

A curing step is a step of converting a skeleton of silica into a strengthen skeleton-reinforced hydrogel after the gelation. The curing temperature is preferably 50 to 100° C. When the curing temperature is lower than 50° C., dehydration condensation reaction becomes relatively slow, and it becomes difficult to sufficiently strengthen the silica network within a target tact period of time in consideration of productivity.

When the curing temperature is higher than 100° C., moisture in the gel remarkably evaporates so that contraction and drying of the gel occur, thereby increasing the thermal conductivity.

The curing time is preferably 0.1 to 12 hours, and more preferably 0.1 to 1 hour from the viewpoint of achieving compatibility of the performance (thermal conductivity) with the production tact.

When the curing time is longer than 12 hours, although reinforcement of the silica network is sufficiently carried out, when more time is taken for the curing, not only the productivity is impaired but also contraction of the gel occurs so that the bulk density increases, thereby raising a problem that the thermal conductivity increases.

When the curing is carried out in the range of 0.1 to 6 hours of the curing time, the network of silica particles can be sufficiently strengthened while the productivity is secured.

(6) Acidic Aqueous Solution Immersing Step

After immersing the composite of the gel and the nonwoven fabric in hydrochloric acid (6 to 12 N), the composite is left at an ordinary temperature of 23° C. for 45 minutes or more to take in the hydrochloric acid inside the composite.

(7) Hydrophobizing Step

The composite of the gel and the nonwoven fabric is immersed in a mixed solution of, for example, octamethyltrisiloxane as a silylating agent and 2-propanol (IPA) as an alcohol, and placed in a constant temperature bath at 55° C. for two hours for reaction. When trimethylsiloxane bonds start to form, hydrochloric acid water is discharged from the gel sheet and separated into two liquids (siloxane in the upper layer and hydrochloric acid water in the lower layer).

(8) Drying Step

The composite of the gel and the nonwoven fabric is transferred to a constant temperature bath at 150° C. and dried for two hours (in the case of ordinary pressure drying).

Soft composite heat insulating material 12 is manufactured through the above steps.

<Manufacture of Laminated Heat Insulator 14>

A method of laminating soft composite heat insulating material 12 with a resin film for reinforcing the strength when soft composite heat insulating material 12 is fitted in partition plate 1 will be described with reference to FIGS. 6A to 6F. FIG. 6A illustrates soft composite heat insulating material 12 as an object to be sealed and laminate film 13 as a sealing body. Laminate film 13 is a resin film thinner than the thickness of soft composite heat insulating material 12, which is made of a thermoplastic resin such as polyethylene, polypropylene, and polyamide. First, as illustrated in FIG. 6B, soft composite heat insulating material 12 is wound by laminate film 13, and as illustrated in FIG. 6C, it is set to a state in which soft composite heat insulating material 12 is wound such that the upper surface has a thickness corresponding to two sheets of laminate film 13 and the lower and side surfaces have a thickness corresponding to one sheet of laminate film 13. Then, as illustrated in FIG. 6D, pressurization and heating are performed from the upper and lower surfaces using a laminator, a roller type heater, or the like to partially melt laminate film 13, and the overlapping portion of the film on the upper surface is welded. Along with this, the films on the upper and lower surfaces and the single fiber layer (single fiber layer 12*b* in FIGS. 5A to 5C) of soft composite heat insulating material 12 are welded (integrated), soft composite heat insulating material 12 and laminate film 13 are integrated (immobilized), and at the same time, the strength of the laminate film on surface A (upper surface) illustrated in FIG. 6E is improved. In this manner, laminated heat insulator 14 illustrated in FIG. 6F is configured. With respect to end portion (compressed portion) 14*a* of laminated heat insulator 14 as also illustrated in FIG. 6F, as illustrated in FIG. 7A, the end portion of laminated heat insulator 14 is strongly pressurized, heated, and compressed so that single fiber layer 12*b* of soft composite heat insulating material 12 and laminate film 13 are welded together as illustrated in the enlarged view of FIG. 7B. In this manner, occurrence of opening and breakage of laminate film 13 at end portion 14*a* of laminated heat insulator 14 is suppressed, and the structure is strengthened. At least one end in the longitudinal direction may be compressed. Moreover, when end portion 14*a* is compressed and thinned, the density becomes high, whereby the structure is strengthened also in this respect.

<Mounting of Laminated Heat Insulator 14 on Design Plate 11>

Figure 8:
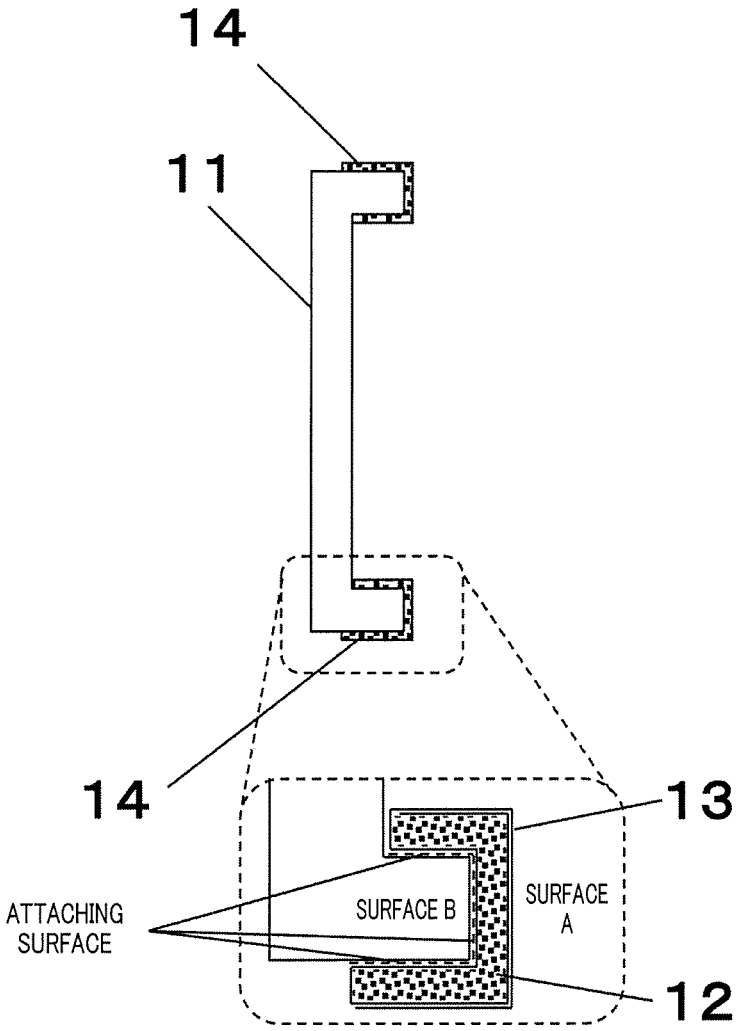
FIG. 8 is a diagram illustrating a method of mounting a laminated heat insulator on a design plate according to Embodiment 1.

A method of mounting laminated heat insulator 14 on design plate 11 is illustrated in FIG. 8. Laminated heat insulator 14 includes surface A in which laminate film 13 is thick, and surface B in which laminate film 13 is thin. As illustrated in FIG. 8, laminated heat insulator 14 is attached to the substantially U-shaped side surface of design plate 11 with thin surface B serving as a mounting surface. By mounting laminated heat insulator 14 in such a positional relationship, when laminated heat insulator 14 mounted on design plate 11 is mounted on upper plate 6 and lower plate 7 of partition plate 1, a thick surface A having a high strength serves as a contact surface with upper plate 6 or lower plate 7, whereby occurrence of breakage and breach of laminated heat insulator 14 can be suppressed.

<Manufacture of Partition Plate 1>

Figure 9:
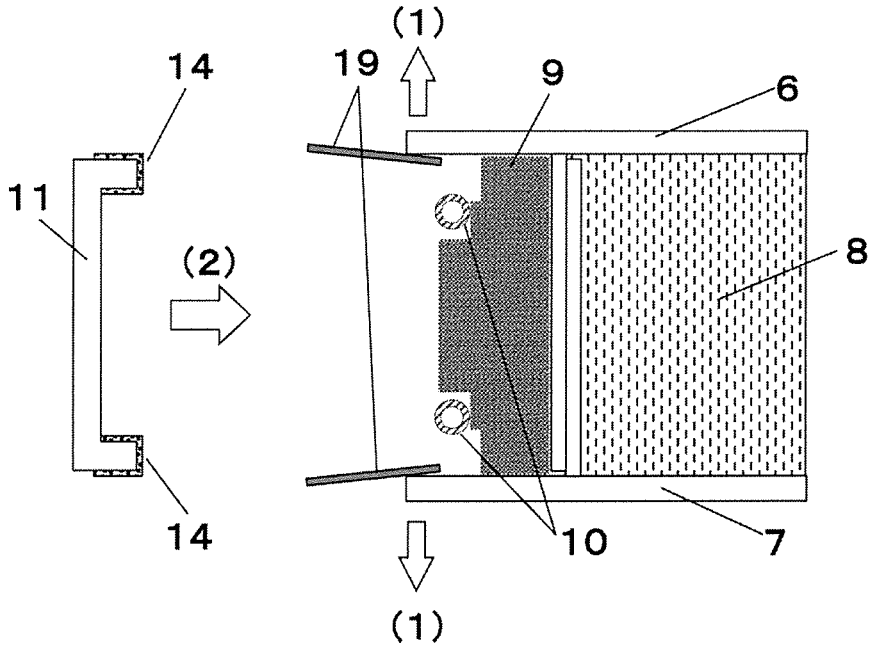
FIG. 9 is a diagram illustrating a method of mounting the design plate on a partition plate according to Embodiment 1.

A method of manufacturing partition plate 1 will be described with reference to FIGS. 1, 2 and 9. In FIG. 1, outer box 5 and inner box 4 are engaged. Then, with respect to the portion of partition plate 1 in the drawing, as illustrated in FIG. 9, design plate 11 on which laminated heat insulator 14 is mounted is sandwiched between upper plate 6 and lower plate 7. When design plate 11 is sandwiched, in a case where the distance between upper plate 6 and lower plate 7 is small, upper plate 6 and lower plate 7 are moved in the direction indicated by arrow (1) in FIG. 9 using mounting jig 19 or the like illustrated in the drawing, and design plate 11 is sandwiched in the direction of arrow (2) in FIG. 9.

Figure 10:
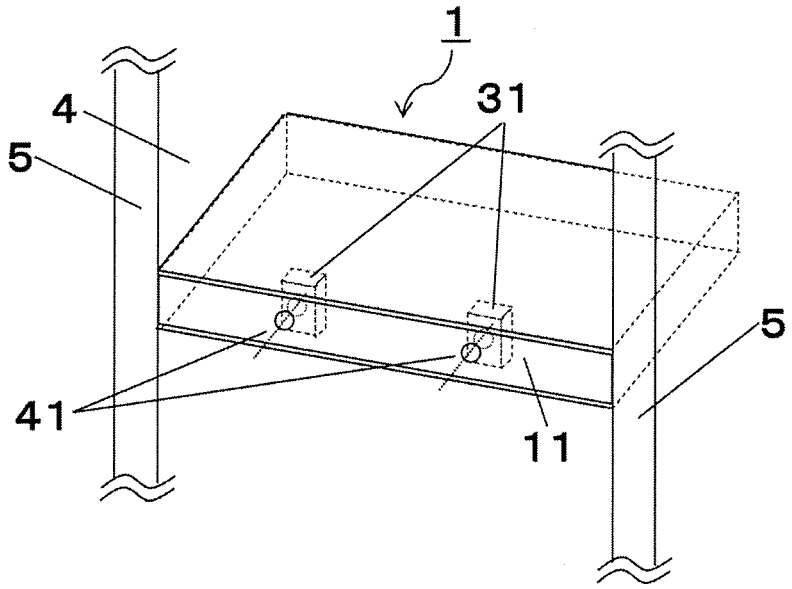
FIG. 10 is a view illustrating a screwing mechanism of the partition plate of a refrigerator according to Embodiments 1 and 2.

The position fixing of design plate 11 is performed as illustrated in FIG. 10. That is, design plate 11 is fixed on rib for mounting partition plate 31 disposed on a part of the region between upper plate 6 and lower plate 7 using a screw (not illustrated) through screw hole 41 provided on design plate 11 in such a manner that it is positioned at the same position of rib 31. At this time, as illustrated in FIG. 2, heat radiation pipe 10 is brought into close contact with design plate 11 by being pressed by foamed flexible heat insulating material 9 between design plate 11 and foamed flexible heat insulating material 9.

Finally, foamed urethane heat insulating material 8 is poured between, from back surface side of refrigerator 100, outer box 5 and inner box 4 in FIG. 1 and between upper plate 6 and lower plate 7 in FIG. 2, and then hardened, thereby manufacturing partition plate 1 and refrigerator 100.

<Effect of Embodiment 1>

Figure 11:
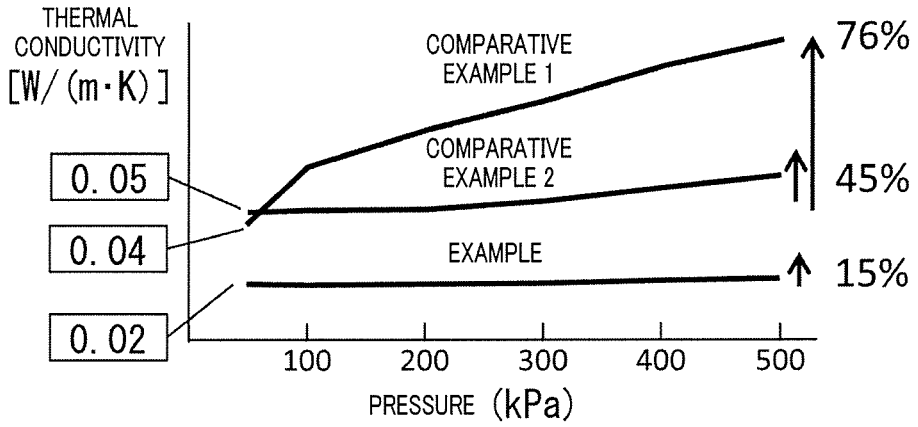
FIG. 11 is a graph illustrating a change in thermal conductivity when the soft composite heat insulating material and another heat insulating material are pressed.

As illustrated in FIG. 2, while the heat of heat radiation pipe 10 is transmitted from the front surface to the side surface of design plate 11 to exert the effect of suppressing occurrence of dew condensation on the surface of the design plate, laminated heat insulator 14 exists on the side surface, the heat is not transmitted to upper plate 6 and lower plate 7 of partition plate 1, whereby heat intrusion into the storage room can be suppressed. In particular, soft composite heat insulating material 12 inside laminated heat insulator 14 is useful since the thermal conductivity hardly changes at the time of receiving a compressive force (pressing). The reason therefor will be described with reference to FIG. 11. FIG. 11 illustrates a result of comparison among soft composite heat insulating material 12 according to Embodiment 1 of the present invention, a heat insulating material made of a foamed resin having the same thickness as comparative example 1, and a resin heat insulating material having the same thickness as comparative example 2 in which the thermal conductivity is measured in a state where various pressures are applied thereto. The heat insulating material made of a foamed resin (Comparative Example 1) has an initial thermal conductivity $\lambda$=0.04 W/m K), which is increased by 76% when a pressure of 500 kPa is applied. Further, the resin heat insulating material (Comparative Example 2) has an initial thermal conductivity $\lambda$=0.05 W/m K), which is increased by 45% when the pressure of 500 kPa is applied. In contrast, the thermal conductivity of soft composite heat insulating material 12 (Example) according to the present invention is increased only by 15% when the pressure of 500 kPa is applied. Therefore, soft composite heat insulating material 12 is suitable for being fixed in a compressed state between design plate 11 and upper plate 6 or lower plate 7, and is effective as a heat insulating material in which the heat insulating effect is not lowered even when it is compressed.

Figures 23A, 23B:
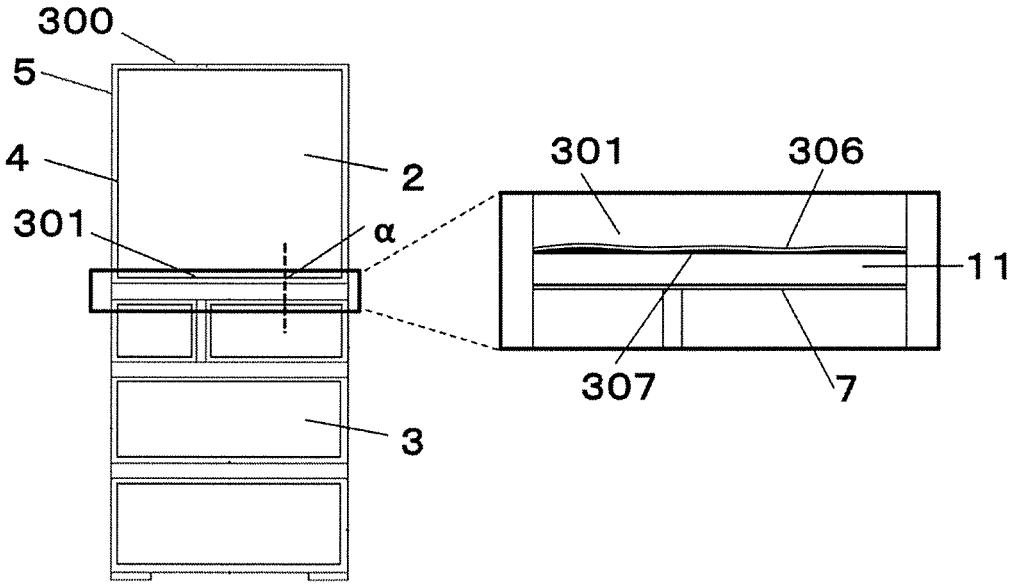
FIG. 23A is a front view of a conventional refrigerator.
FIG. 23B is a view illustrating an opening state of a peripheral region of a design plate of the conventional refrigerator.

Furthermore, laminated heat insulator 14 is mounted in a compressed state between design plate 11 and upper plate 6 of partition plate 1 or between design plate 11 and lower plate 7 of partition plate 1, and plays a role of maintaining the positional accuracy of the gap between the design plate and the upper plate or between the design plate and the lower plate. That is, when the refrigerator is viewed from the front, laminated heat insulator 14 suppresses the occurrence of the opening state (waving) between the upper plate or the lower plate and the design plate as illustrated in FIGS. 23A and 23B, maintains the aesthetic appearance of the refrigerator, and suppress intrusion of moisture and foreign matter from the opening portion, thereby maintaining the performance of the refrigerator.

Embodiment 2

Figure 12:
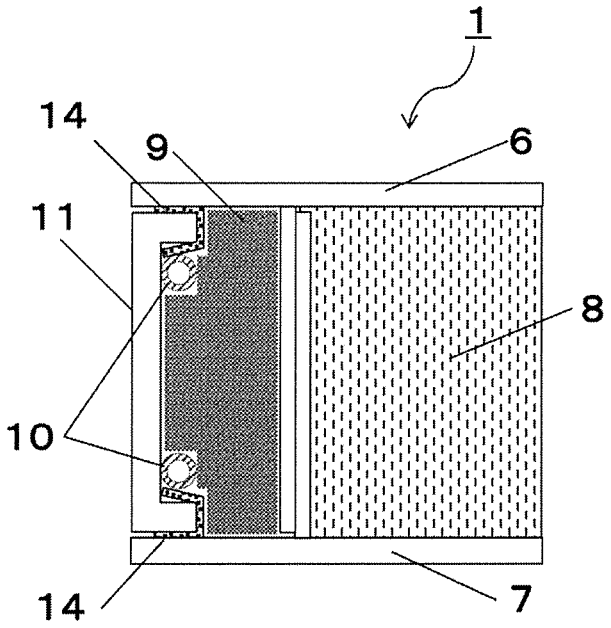
FIG. 12 is a longitudinal cross-sectional view of portion α in FIG. 1 according Embodiment 2.

Embodiment 2 will be described with reference to FIG. 12. FIG. 12 is a longitudinal cross-sectional view of portion $\alpha$ in FIG. 1. In Embodiment 2, a configuration and a method of manufacturing refrigerator 100, a method of manufacturing partition plate 1, and a method of manufacturing soft composite heat insulating material 12 and laminated heat insulator 14 are the same as those in Embodiment 1. The present embodiment is different from Embodiment 1 in a method of mounting laminated heat insulator 14 on design plate 11 illustrated in FIG. 12. Items not to be described are the same as those in above-described Embodiment 1.

<Mounting of Laminated Heat Insulator 14 on Design Plate 11>

Figure 13:
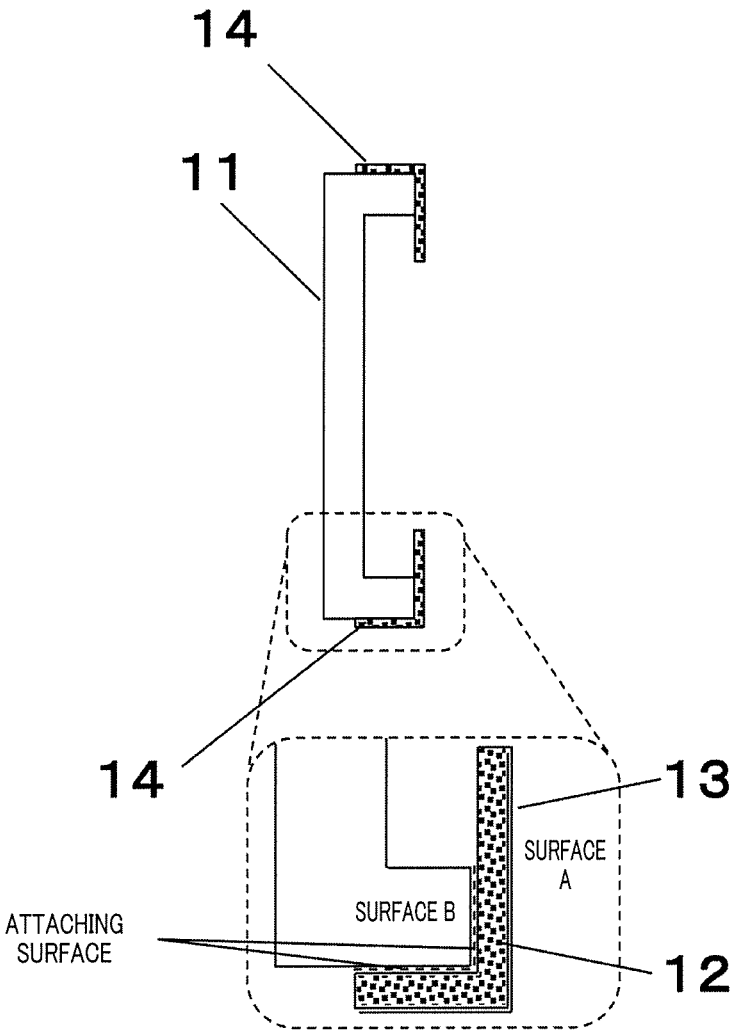
FIG. 13 is a diagram illustrating a method of mounting a laminated heat insulator on a design plate according to Embodiment 2.

A method of mounting laminated heat insulator 14 on design plate 11 is illustrated in FIG. 13. Laminated heat insulator 14 includes surface A in which laminate film 13 is thick, and surface B in which laminate film 13 is thin. As illustrated in FIG. 13, laminated heat insulator 14 is attached to a substantially U-shaped side surface of design plate 11 with thin surface B serving as a mounting surface. It is different from the configuration of Embodiment 1 in that a surface of laminated heat insulator 14 to be attached to design plate 11 is only two surfaces as illustrated in the drawing.

<Manufacture of Partition Plate 1>

Figure 14A:
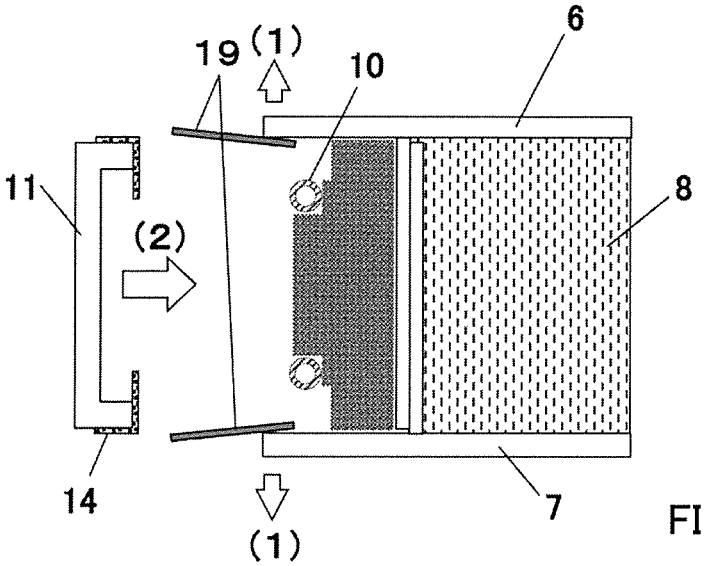
FIGS. 14A to 14C are views illustrating a method of mounting the design plate on a partition plate and an effect according to Embodiment 2.

A method of manufacturing partition plate 1 will be described with reference to FIGS. 1 and 14A to 14C. In FIG. 1, outer box 5 and inner box 4 are engaged. Then, with respect to the portion of partition plate 1 in the drawing, as illustrated in FIG. 14A, design plate 11 on which laminated heat insulator 14 is mounted is sandwiched between upper plate 6 and lower plate 7. When design plate 11 is sandwiched, in a case where a distance between upper plate 6 and lower plate 7 is small, upper plate 6 and lower plate 7 are moved in the direction indicated by arrow (1) in FIG. 14A using mounting jig 19 or the like illustrated in the drawing, and design plate 11 is pushed in the direction of arrow (2) in the drawing to be sandwiched between upper plate 6 and lower plate 7.

Figure 14B:
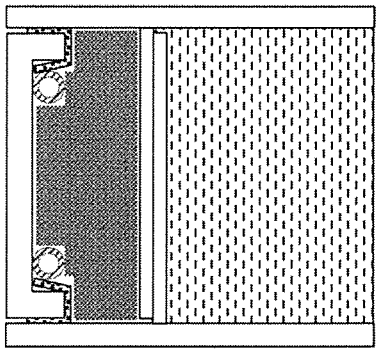
Figure 14C:
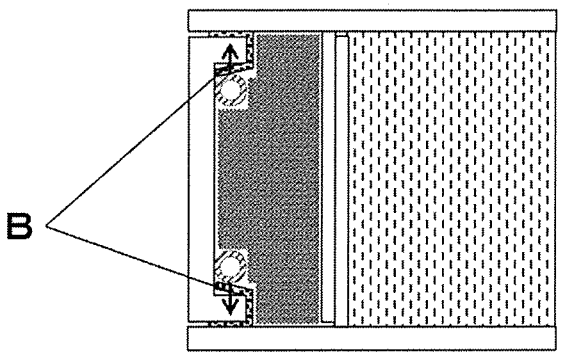

At this time, since heat radiation pipe 10 exists in the direction in which design plate 11 is pushed, the portion not attached to design plate 11 with respect to laminated heat insulator 14 is pushed by heat radiation pipe 10 at the time of sandwiching design plate 11 with upper plate 6 and lower plate 7, thereby becoming the configuration illustrated in FIG. 14B. According to the present configuration, the cost for attaching laminated heat insulator 14 to design plate 11 in FIG. 13 is suppressed, and as illustrated in FIG. 14C, intrusion of heat from heat radiation pipe 10, which is directly transmitted to the side surface of design plate 11 via air, into a storage room can also be suppressed.

When a position of design plate 11 is fixed, in a similar manner to Embodiment 1, screw fixing is performed as illustrated in FIG. 10. Finally, in a similar manner to Embodiment 1, foamed urethane heat insulating material 8 is poured between, from back surface side of refrigerator 100, outer box 5 and inner box 4 in FIG. 1 and between upper plate 6 and lower plate 7 in FIG. 2, and then hardened, thereby manufacturing partition plate 1 and refrigerator 100.

<Effect of Embodiment 2>

Figure 20:
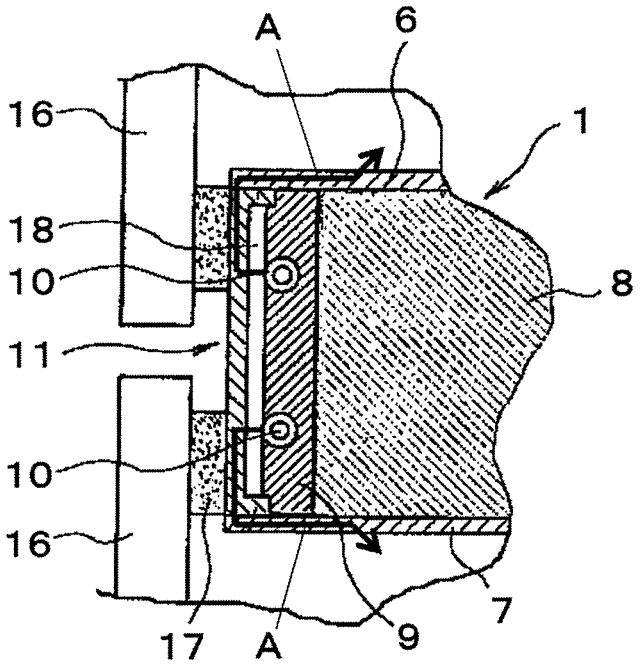
FIG. 20 is a longitudinal cross-sectional view of portion α in FIG. 19 disclosed in PTL 1.
Figure 21:
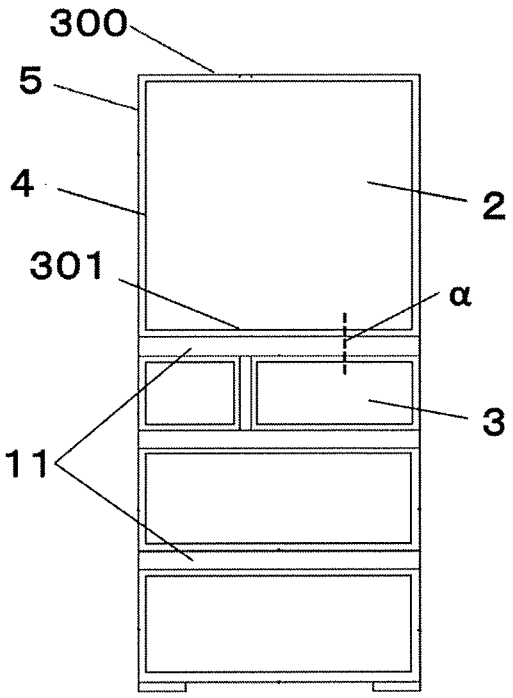
FIG. 21 is a view illustrating a structure of a conventional refrigerator disclosed in PTL 2.
Figure 22:
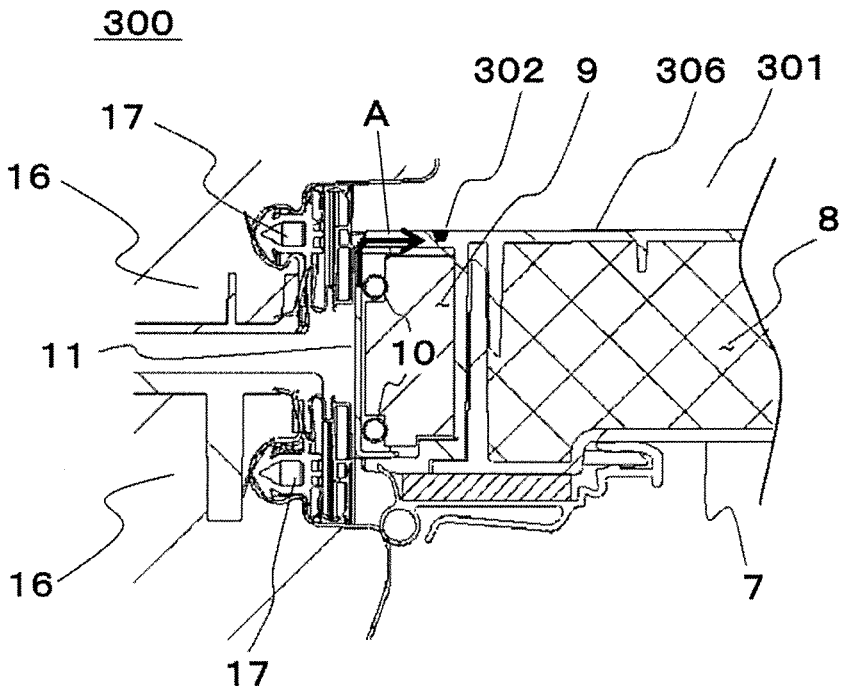
FIG. 22 is a longitudinal cross-sectional view of portion α in FIG. 21 disclosed in PTL 2.

According to Embodiment 2 illustrated in FIG. 12, the effects similar to those in Embodiment 1 (effect of suppressing dew condensation, effect of suppressing heat intrusion into the storage room through path A illustrated in FIG. 20, and effect of maintaining aesthetic appearance and performance of a refrigerator) can be obtained. In addition, according to Embodiment 2, the effect of suppressing the cost for attaching laminated heat insulator 14 to design plate 11 described with reference to FIG. 13, and the effect of suppressing heat intrusion into the storage room through the paths indicated by arrow B illustrated in FIG. 14C can also be obtained.

Embodiment 3

Laminated heat insulator 14 is mounted on design plate 11 in Embodiment 3, which will be described with reference to FIG. 15. Items not to be described are similar to those in above-described Embodiments.

<Mounting of Laminated Heat Insulator 14 on Design Plate 11>

Figure 15:
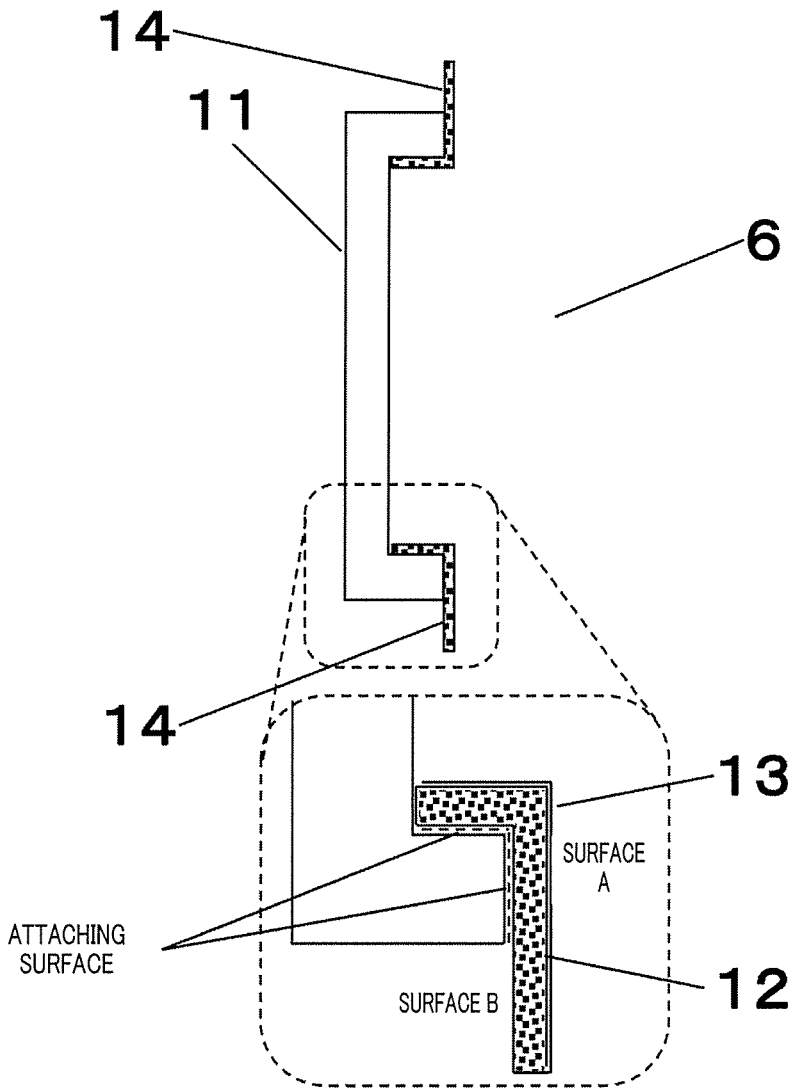
FIG. 15 is a diagram illustrating a method of mounting a laminated heat insulator on a design plate according to Embodiment 3.

A method of mounting laminated heat insulator 14 on design plate 11 is illustrated in FIG. 15. Laminated heat insulator 14 includes surface A in which laminate film 13 is thick, and surface B in which laminate film 13 is thin. As illustrated in FIG. 13, laminated heat insulator 14 is attached to a substantially U-shaped side surface of design plate 11 with thin surface B serving as a mounting surface. It is different from the configuration of Embodiment 1 in that a surface of laminated heat insulator 14 to be attached to design plate 11 is only two surfaces as illustrated in the drawing. Further, a position of the two surfaces to be attached is different from that in Embodiment 2.

<Manufacture of Partition Plate 1>

A method of manufacturing partition plate 1 will be described with reference to FIGS. 1, 16A and 16B. In FIG.

1, outer box 5 and inner box 4 are engaged. Then, with respect to the portion of partition plate 1 in the drawing, as illustrated in FIG. 16A, design plate 11 on which laminated heat insulator 14 is mounted is sandwiched between upper plate 6 and lower plate 7. When design plate 11 is sandwiched, in a case where a distance between upper plate 6 and lower plate 7 is small, upper plate 6 and lower plate 7 are moved in the direction indicated by arrow (1) in FIG. 16A using mounting jig 19 or the like illustrated in the drawing, and design plate 11 is pushed in the direction of arrow (2) in FIG. 16A to be sandwiched between upper plate 6 and lower plate 7. When sandwiched in this manner, the portion protruding outside with respect to laminated heat insulator 14 attached to design plate 11 in FIG. 16A is mounted in a manner sandwiched between upper plate 6 or lower plate 7 and design plate 11, thereby becoming the structure illustrated in FIG. 16B. That is, the structure becomes similar to that in FIG. 2 described in Embodiment 1.

<Effect of Embodiment 3>

Figure 16A:
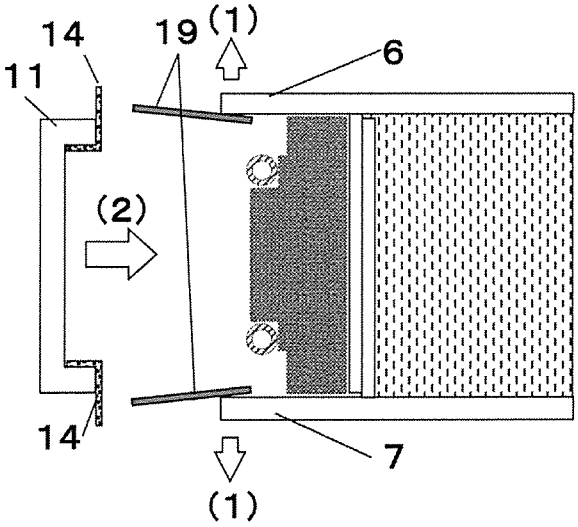
FIGS. 16A and 16B are views illustrating a method of mounting the design plate on a partition plate according to Embodiment 3.
Figure 16B:
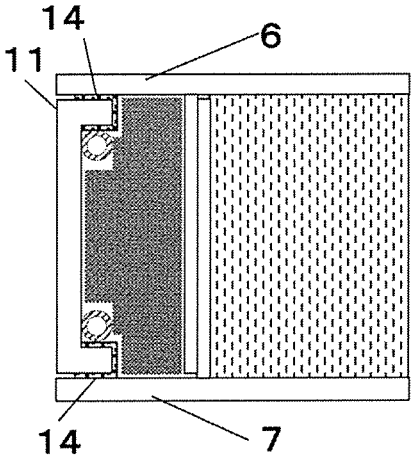

According to Embodiment 3 illustrated in FIGS. 15, 16A, and 16B, the effects described in Embodiment 1 (effect of suppressing dew condensation, effect of suppressing heat intrusion into a storage room through path A illustrated in FIG. 20, and effect of maintaining aesthetic appearance and performance of a refrigerator) can be obtained. In addition, according to Embodiment 2, the effect of suppressing the cost for attaching laminated heat insulator 14 to design plate 11 described with reference to FIG. 13 can also be obtained.

Embodiment 4

Figure 17:
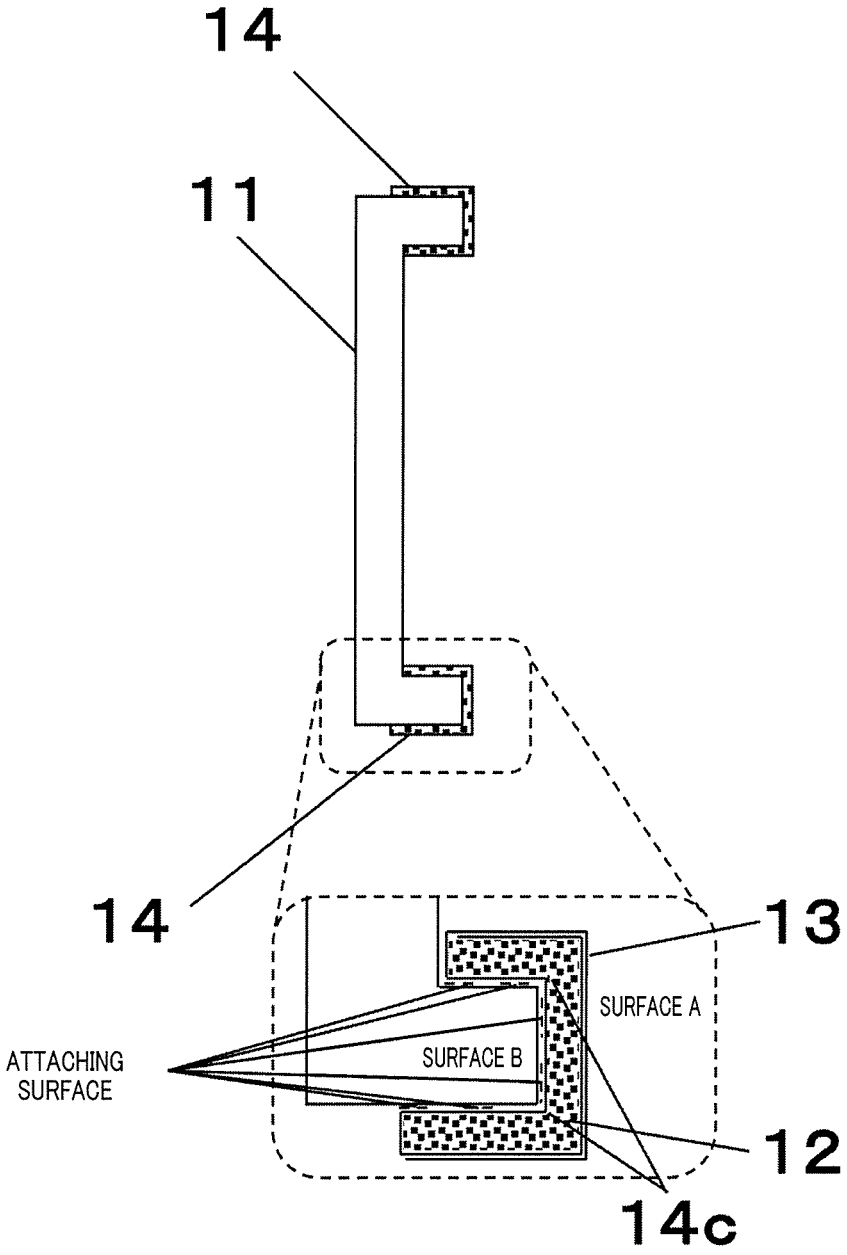
FIG. 17 is a view illustrating a method of mounting a laminated heat insulator on a design plate according to Embodiment 4.

Embodiment 4 will be described with reference to FIG. 17. FIG. 17 is an enlarged view illustrating an attached state of design plate 11 and laminated heat insulator 14 in FIG. 2. A configuration and a method of manufacturing refrigerator 100, a method of manufacturing partition plate 1, a method of manufacturing soft composite heat insulating material 12 and laminated heat insulator 14, and a method of manufacturing partition plate 1 are the same as those in Embodiments 1 to 3. The present embodiment is different from Embodiments 1 to 3 in a method of mounting laminated heat insulator 14 on design plate 11 illustrated in FIG. 17.

<Mounting of Laminated Heat Insulator 14 on Design Plate 11>

A method of mounting laminated heat insulator 14 on design plate 11 is illustrated in FIG. 17. Laminated heat insulator 14 includes surface A in which laminate film 13 is thick, and surface B in which laminate film 13 is thin. As illustrated in FIG. 17, laminated heat insulator 14 is attached to a substantially U-shaped side surface of design plate 11 with thin surface B serving as a mounting surface. It is different from the configurations of Embodiments 1 to 3 in that a surface of laminated heat insulator 14 to be attached to design plate 11 is not an entire surface, but a part thereof (with intervals). In other words, laminated heat insulator 14 is partially adhered to design plate 11.

<Effect of Embodiment 4>

With the method of attaching with intervals illustrated in FIG. 17 according to Embodiment 4, stress of the attached surface caused by a difference in elongation with respect to surface A side and surface B side of laminated heat insulator 14 is dispersed, whereby occurrence of a wrinkle of a laminate film, which tends to occur at corner 14*c*, can be suppressed. In other words, adhesion between laminated heat insulator 14 and design plate 11 on surface B can be improved, and heat insulating effect can be enhanced.

Embodiment 5

Figures 18A, 18B, 18C:
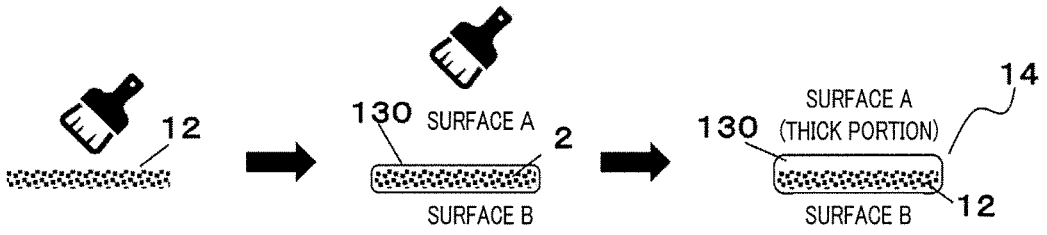
FIG. 18A is a diagram illustrating a state of a soft composite heat insulating material before being coated with a resin according to Embodiment 5.
FIG. 18B is a diagram illustrating a state of the soft composite heat insulating material being coated with the resin according to Embodiment 5.
FIG. 18C is a diagram illustrating a state of the soft composite heat insulating material after being coated with the resin according to Embodiment 5.
Figure 19:
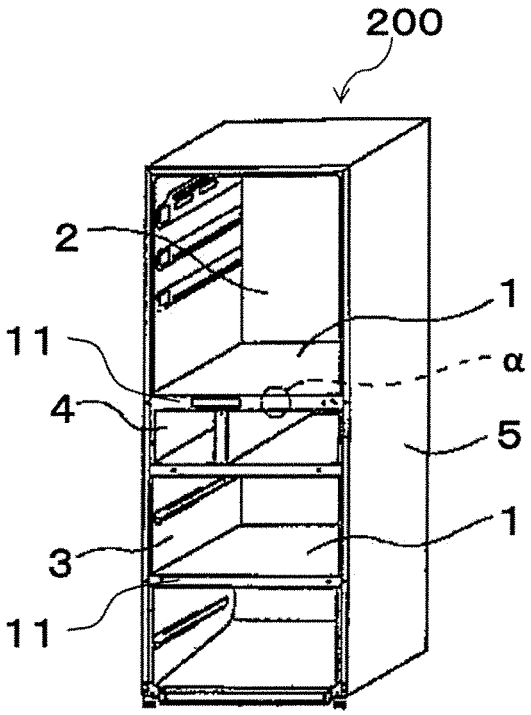
FIG. 19 is a view illustrating a structure of a conventional refrigerator disclosed in PTL 1.

Embodiment 5 will be described with reference to FIGS. 18A to 18C. FIGS. 18A to 18C illustrate a method of manufacturing laminated heat insulator 14 illustrated in FIG. 2.

A configuration and a method of manufacturing refrigerator 100, a method of manufacturing partition plate 1, a method of manufacturing soft composite heat insulating material 12, a method of mounting laminated heat insulator 14 on design plate 11, and a method of manufacturing partition plate 1 are the same as those in Embodiments 1 to 4. The present Embodiment 5 is different from Embodiments 1 to 4 in a method of manufacturing laminated heat insulator 14 illustrated in FIGS. 18A to 18C.

<Manufacture of Laminated Heat Insulator 14>

In order to reinforce the strength when soft composite heat insulating material 12 is fitted in partition plate 1, a method of laminating soft composite heat insulating material 12 with a coating of a resin material will be described with reference to FIGS. 18A to 18C.

First, as illustrated in FIG. 18B, an application tool such as a brush is used for coating, while not generating a gap, soft composite heat insulating material 12 as an object to be sealed illustrated in FIG. 18A with coating material 130. Coating material 130 is a resin material, and is preferably a resin of an acrylic type, a silicon type, or a urethane type. Further, in order to form thick A surface, as illustrated in FIG. 18C, coating material 130 is thickly applied only on one side to be surface A. By manufacturing in this manner, laminated heat insulator 14 illustrated in FIG. 18C in which the laminate material (coating material 130) on one side is thick is formed.

<Effect of Embodiment 5>

A method of lamination using coating material 130 of laminated heat insulator 14 according to Embodiment 5 illustrated in FIGS. 18A to 18C does not require a press-contact machine such as a roller type heater used for the method of lamination with the film according to Embodiments 1 to 4, and laminated heat insulator 14 can be configured in a simplified manner.

With regard to the method of lamination, it is preferable to select the method according to Embodiments 1 to 4 or the method according to Embodiment 5 depending on the number of heat insulating materials to be manufactured and the manufacturing tact.

INDUSTRIAL APPLICABILITY

The present invention is useful for any type of refrigerator (household refrigerator, commercial refrigerator, wine cellar, etc.) having a mechanism of dividing a room of a plurality of temperature zones with a partition plate, which is required to improve a heat insulating property.

REFERENCE SIGNS LIST

1 partition plate
2 first storage room
3 second storage room
4 inner box
5 outer box
6 upper plate
7 lower plate

8 foamed urethane heat insulating material
9 foamed flexible heat insulating material
10 heat radiation pipe
11 design plate
12 soft composite heat insulating material
12*a* aerogel fiber composite layer
12*b* single fiber layer
12*c* nonwoven fabric fiber
12*d* aerogel
012*a* nonwoven fabric sol composite
012*b* nonwoven fabric
13 laminate film
14 laminated heat insulator
14*a* end portion
14*c* corner
16 door
17 gasket
18 heat storage layer
19 mounting jig
41 screw hole
31 rib for mounting partition plate
100 refrigerator
130 coating material
200 refrigerator
300 refrigerator
301 partition plate
302 heat barrier
306 upper plate
307 opening portion

The invention claimed is:

1. A refrigerator comprising:
a partition plate that partitions a room into a plurality of rooms; and
a door that seals the plurality of rooms,
wherein the partition plate includes:
an upper plate that positions on upper side;
a lower plate that positions on lower side;
a design plate that positions between the upper plate and the lower plate; and
a heat insulating material including a compressed portion fixed in a compressed state, at least one of between a first surface of an upper surface of the design plate and a second surface of the upper plate facing to the first surface, or between a third surface of a lower surface of the design plate and a fourth surface of the lower plate facing to the third surface, and
the compressed portion has a thickness smaller than a thickness of other portions of the heat insulating material, which are not in a compressed state.

2. The refrigerator according to claim 1, wherein the heat insulating material has a three-layer structure in which a composite of an aerogel and a fiber structure is compressed between two single fiber layers in a stacking direction of the three-layer structure.

3. The refrigerator according to claim 1, wherein the heat insulating material is provided on a side surface of the design plate facing the upper plate or the lower plate.

4. The refrigerator according to claim 1, wherein the heat insulating material includes an end portion in a longitudinal direction, and the end portion is compressed compared to other portions of the heat insulating material.

5. The refrigerator according to claim 1, wherein the design plate has a U-shape.

6. The refrigerator according to claim 5, wherein the U-shape has a front portion and two leg portions and one the two leg portions faces the lower plate and another of the two leg portions faces the upper plate.

7. The refrigerator according to claim 1, wherein the heat insulating material is a laminated heat insulator comprising composite heat insulating material wrapped by a film.

8. A refrigerator comprising:
a partition plate that partitions a room into a plurality of rooms; and
a door that seals the plurality of rooms,
wherein the partition plate includes:
an upper plate that positions on upper side;
a lower plate that positions on lower side;
a design plate that positions between the upper plate and the lower plate; and
a heat insulating material fixed between the design plate and at least one of the upper plate or the lower plate in a compressed state, and including a compressed portion having a thickness smaller than a thickness of other portions, and
wherein a resin material is disposed on a surface of the heat insulating material.

9. The refrigerator according to claim 8, wherein the resin material on one surface of the heat insulating material is thicker than a resin material on the other surface of the heat insulating material.

10. The refrigerator according to claim 9, wherein the heat insulating material is disposed on the design plate with the one surface facing the upper plate or the lower plate.

11. The refrigerator according to claim 9, wherein the heat insulating material is bent in such a manner that the one surface is outside and the other surface is inside.

12. The refrigerator according to claim 8, wherein the heat insulating material is partially adhered to the design plate.

13. The refrigerator according to claim 8, wherein the resin material is a resin film.

14. The refrigerator according to claim 8, wherein the resin material is a liquid resin for coating.

15. A refrigerator comprising:
a partition plate that partitions a room into a plurality of rooms; and
a door that seals the plurality of rooms,
wherein the partition plate includes:
an upper plate that positions on upper side;
a lower plate that positions on lower side;
a design plate that positions between the upper plate and the lower plate; and
a heat insulating material fixed between the design plate and at least one of the upper plate or the lower plate in a compressed state, and including a compressed portion having a thickness smaller than a thickness of other portions, and
wherein a heat radiation section is provided between the upper plate and the lower plate, and the heat insulating material is in contact with the heat radiation section.

* * * * *